US007656090B2

(12) United States Patent
Kang

(10) Patent No.: US 7,656,090 B2
(45) Date of Patent: Feb. 2, 2010

(54) PLASMA DISPLAY PANEL DESIGN RESULTING IN IMPROVED LUMINOUS EFFICIENCY AND REDUCED REACTIVE POWER

(75) Inventor: Kyoung-Doo Kang, Suwon-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 637 days.

(21) Appl. No.: 11/401,939

(22) Filed: Apr. 12, 2006

(65) Prior Publication Data

US 2006/0238123 A1 Oct. 26, 2006

(30) Foreign Application Priority Data

Apr. 26, 2005 (KR) ..... 10-2005-0034492

(51) Int. Cl.
*H01J 17/49* (2006.01)

(52) U.S. Cl. ..... 313/586; 313/587

(58) Field of Classification Search ..... 313/506, 313/507

See application file for complete search history.

(56) References Cited

U.S. PATENT DOCUMENTS 5,371,437 A * 12/1994 Amano ..... 315/169.1
5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,744,909 A * 4/1998 Amano ..... 313/585
5,786,794 A 7/1998 Kishi et al.

(Continued)

FOREIGN PATENT DOCUMENTS

EP 1 659 610 5/2006

(Continued)

OTHER PUBLICATIONS

European Search Report for European Patent Application No. 06112232.1-2208, issued on Jan. 26, 2007.

(Continued)

*Primary Examiner*—Peter Macchiarolo
(74) *Attorney, Agent, or Firm*—Robert E. Bushnell, Esq.

(57) ABSTRACT

Provided is a plasma display panel including a rear substrate, a front substrate separated from the rear substrate, a plurality of barrier ribs arranged between the front substrate and the rear substrate and adapted to define a plurality of discharge cells corresponding to a plurality of sub-pixels, a plurality of sustain electrode pairs comprising a plurality of first discharge electrodes and a plurality of second discharge electrodes extending parallel to each other and surrounding ones of the plurality of discharge cells, the plurality of sustain electrode pairs being adapted to generate a discharge, a plurality of address electrodes extending and surrounding the plurality of discharge cells and arranged in a direction that crosses the plurality of sustain electrode pairs, a plurality of phosphor layers arranged within the plurality of discharge cells and a discharge gas arranged within the plurality of discharge cells, wherein a predetermined number of sub-pixels form a unit pixel, and unit pixels adjacent to each other in a direction are spaced apart from each other by a predetermined distance.

21 Claims, 10 Drawing Sheets

U.S. PATENT DOCUMENTS

| | | | | |
|---|---|---|---|---|
| 5,906,527 | A * | 5/1999 | Shaikh et al. | 445/24 |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,873,105 | B2 * | 3/2005 | Akiba | 313/586 |
| 2002/0145387 | A1 | 10/2002 | Akiba | |
| 2005/0116646 | A1 | 6/2005 | Yoo et al. | |
| 2006/0125395 | A1 * | 6/2006 | Kang | 313/582 |

FOREIGN PATENT DOCUMENTS

| | | |
|---|---|---|
| JP | 48-71967 | 9/1973 |
| JP | 2845183 | 10/1998 |
| JP | 2917279 | 4/1999 |
| JP | 11-306996 | 11/1999 |
| JP | 2001-043804 | 2/2001 |
| JP | 2001-325888 | 11/2001 |
| JP | 2004-235042 | 8/2004 |
| JP | 2005-209637 | 8/2005 |
| WO | WO 03017314 A1 * | 2/2003 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Office action from the Japanese Patent Office issued in Applicant's corresponding Japanese Application No. 2006-103447 dated Mar. 3, 2009.

* cited by examiner

PLASMA DISPLAY PANEL DESIGN RESULTING IN IMPROVED LUMINOUS EFFICIENCY AND REDUCED REACTIVE POWER

CLAIM OF PRIORITY

This application makes reference to, incorporates the same herein, and claims all benefits accruing under U.S.C. § 119 from an application for PLASMA DISPLAY PANEL earlier filed in the Korean Intellectual Property Office on 26 Apr. 2005 and there duly assigned Serial No. 10-2005-0034492.

BACKGROUND OF THE INVENTION

1. Field of the Invention

The present invention relates to a plasma display panel having a new structure.

2. Description of the Related Art

Plasma display panels are flat panel displays displaying an image via gas discharge. Plasma display panels are considered to be the next generation of flat panel displays due to superior display properties such as display capacity, brightness, contrast, residual image, and wide viewing angle. The plasma display panel includes a rear substrate and a front substrate facing each other, spaced apart from each other and coupled to each other. A plurality of address electrodes are arranged on a front surface of the rear substrate, and the address electrodes are covered by a first dielectric layer. Sustain electrode pairs crossing the address electrodes are formed on a rear surface of the front substrate. In each sustain electrode pair is an X electrode and a Y electrode. The sustain electrode pairs are covered by a second dielectric layer, and a protective layer is formed on a rear surface of the second dielectric layer. In addition, barrier ribs define discharge cells on a front surface of the first dielectric layer. Phosphor layers are applied to predetermined thicknesses in the discharge cells defined by the barrier ribs.

In the plasma display panel having the above structure, a discharge cell is selected by an address discharge between the address electrode and the Y electrode, and then the discharge cell emits visible light by a sustain discharge occurring between the X electrode and the Y electrode. In more detail, a discharge gas filled within the discharge cell emits ultraviolet rays during the sustain discharge, and the ultraviolet rays excite the phosphor layers to emit visible light. The visible light emitted from the phosphor layers produces an image on the plasma display panel.

However, in the plasma display panel having the above structure, the sustain discharge occurs only in the space between the X electrode and the Y electrode adjacent to the protective layer. Thus the volume of the space where the sustain discharge occurs is small. In addition, some of the visible light emitted from the phosphor layers is absorbed and/or reflected by the protective layer, the second dielectric layer, and the sustain electrodes and. Thus, only 60% of the visible light emitted from the phosphor layers can pass through the front substrate. Therefore, luminous efficiency and brightness of the panel are reduced. Therefore, what is needed is an improved design for a plasma display panel that overcomes these problems.

SUMMARY OF THE INVENTION

It is therefore an object of the present invention to provide an improved design for a plasma display panel.

It is also an object of the present invention to provide a plasma display panel having improved luminous efficiency.

It is further an object of the present invention to provide a plasma display panel having improved brightness.

It is still an object of the present invention to provide a plasma display panel with reduced reactive power.

It is yet an object of the present invention to provide a plasma display panel that prevents formation of a permanent residual image.

It is still an object of the present invention to provide a plasma display panel where there is sufficient and unobstructed volume for sustain discharge.

These and other objects can be achieved by a plasma display panel that includes a rear substrate, a front substrate separated from the rear substrate, a plurality of barrier ribs arranged between the front substrate and the rear substrate and adapted to define a plurality of discharge cells corresponding to a plurality of sub-pixels, a plurality of sustain electrode pairs comprising a plurality of first discharge electrodes and a plurality of second discharge electrodes extending parallel to each other and at least portions of surrounding ones of the plurality of discharge cells, the plurality of sustain electrode pairs being adapted to generate a discharge, a plurality of address electrodes surrounding at least portions of the plurality of discharge cells and arranged in a direction that crosses the plurality of sustain electrode pairs, a plurality of phosphor layers arranged within the plurality of discharge cells and a discharge gas arranged within the plurality of discharge cells, wherein a predetermined number of sub-pixels form a unit pixel, and unit pixels adjacent to each other in a direction are spaced apart from each other by a predetermined distance.

Unit pixels arranged in a direction that the plurality of sustain electrode pairs extend can be spaced apart from each other at predetermined intervals. Unit pixels arranged in the direction that the plurality of address electrodes extend can be spaced apart from each other at predetermined intervals. Ones of the plurality of barrier ribs arranged between two separate and adjoining unit pixels can be separated from each other at a predetermined interval and a spaced portion between the adjoining unit pixels comprises a non-discharge area. Ones of said plurality of barrier ribs arranged between two separate and adjoining unit pixels can have a wider width than ones of said plurality of barrier ribs arranged within a single unit pixel.

The plurality of barrier ribs can include a plurality of transverse barrier ribs that extend in the direction parallel to the address electrodes and a plurality of longitudinal barrier ribs that extend in a direction that crosses the plurality of transverse barrier ribs. Widths of ones of said plurality of longitudinal barrier ribs arranged between two separate and adjoining unit pixels can be larger than widths of ones of said plurality of longitudinal barrier ribs arranged within a single unit pixel. Widths of ones of said plurality of transverse barrier ribs arranged between two separate and adjoining unit pixels are larger than widths of ones of said plurality of transverse barrier ribs arranged within a single unit pixel.

Each unit pixel can include four sub-pixels. Each unit pixel can include one red sub-pixel, one green sub-pixel, and two blue sub-pixels. Each sub-pixel can have substantially a square shape. Each unit pixel can have substantially a square shape.

Each unit pixel can include three sub-pixels. Each sub-pixel can have substantially a rectangular shape. Each unit pixel can include one red sub-pixel, one green sub-pixel, and one blue sub-pixel.

The plurality of first discharge electrodes and the plurality of second discharge electrodes can be arranged within the plurality of barrier ribs and can be separated from each other in a direction perpendicular to the front substrate, The plurality of barrier ribs can include a dielectric material. The plurality of address electrodes can be arranged within the plurality of barrier ribs, the plurality of barrier ribs can include a dielectric material. The plurality of phosphor layers can be arranged between the front substrate and the plurality of sustain electrode pairs. A plurality of grooves can be arranged in the front substrate, the plurality of grooves can correspond to the plurality of discharge cells. The plurality of phosphor layers can be arranged within the plurality of grooves. The plurality of grooves can be discontinuously arranged on the front substrate and can correspond to the plurality of discharge cells. The plasma display panel can further include a plurality of protective layers covering at least some portions of sidewalls of the plurality of barrier ribs.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
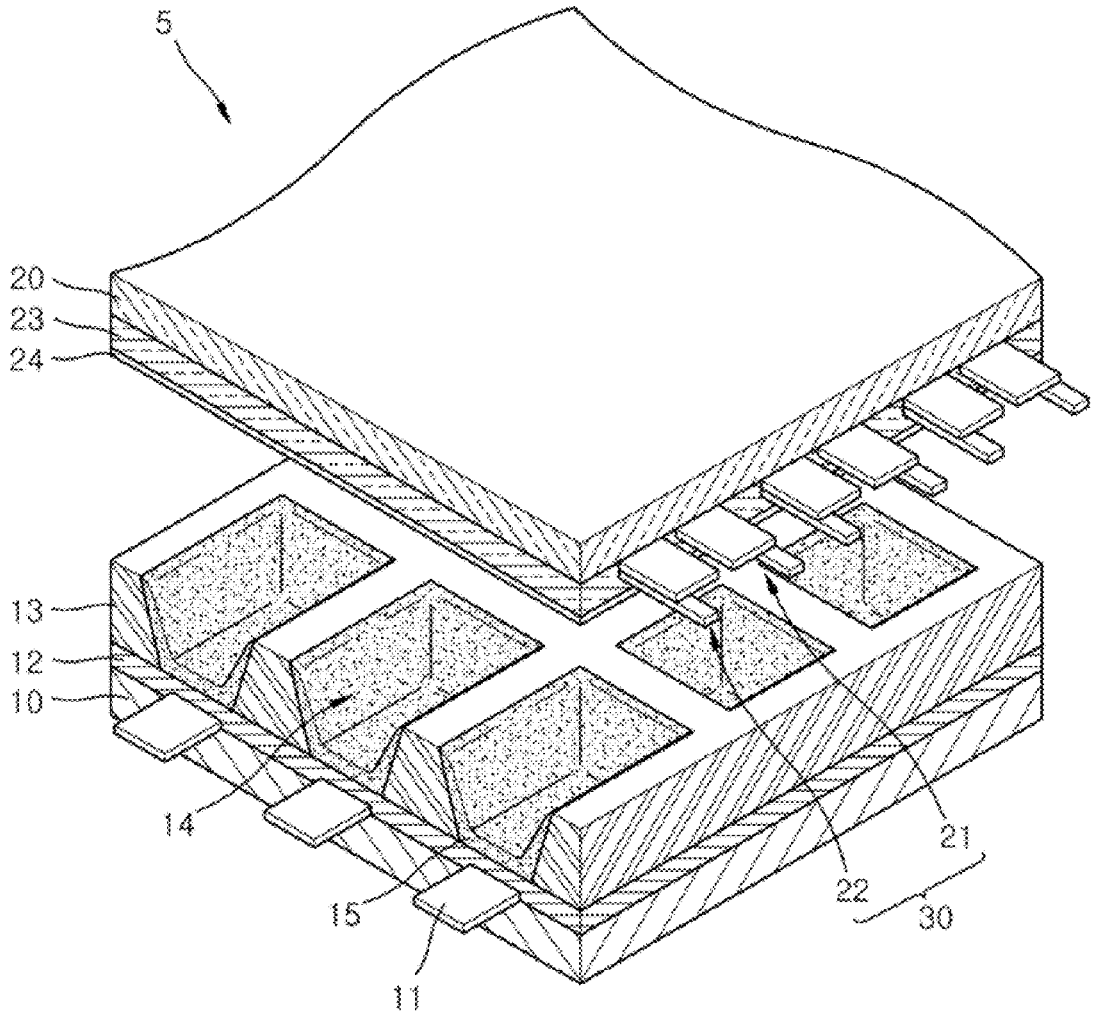
FIG. 1 (RELATED ART)
FIG. 1 is an exploded perspective view of a plasma display panel.

Turning now to the figures, FIG. 1 is an exploded perspective view of an alternating current (AC) three-electrode surface discharge plasma display panel 5. Referring to FIG. 1, the plasma display panel 5 includes a rear substrate 10 and a front substrate 20 facing each other, spaced apart from each other and coupled to each other. A plurality of address electrodes 11 are arranged on a front surface of the rear substrate 10, and the address electrodes 11 are covered by a first dielectric layer 12. Sustain electrode pairs 30 crossing the address electrodes 11 are formed on a rear surface of the front substrate 20. In each of the pairs 30 is an X electrode 21 and a Y electrode 22. The sustain electrode pairs 30 are covered by a second dielectric layer 23, and a protective layer 24 is formed on a rear surface of the second dielectric layer 23. In addition, barrier ribs 13 define discharge cells 14 and are formed on a front surface of the first dielectric layer 12. Phosphor layers 15 are applied to predetermined thicknesses within the discharge cells 14 defined by the barrier ribs 13.

In the plasma display panel 5 having the above structure, the discharge cells 14 are selected by an address discharge between the address electrodes 11 and the Y electrodes 22. When selected, the discharge cell 14 emits visible light by during a sustain discharge occurring between an X electrode 21 and a Y electrode 22. In more detail, a discharge gas filled within the discharge cell 14 emits ultraviolet rays during the sustain discharge, and the ultraviolet rays excite the phosphor layers 15 to emit the visible light. The visible light emitted from the phosphor layers 15 produces an image on the plasma display panel 5.

In the plasma display panel 5 having the above structure, the sustain discharge occurs only in the space between the X electrode 21 and the Y electrode 22 adjacent to the protective layer 24. As a result, the volume of this space where the sustain discharge occurs is small. In addition, some of the visible light emitted from the phosphor layers 15 is absorbed and/or reflected by the protective layer 24, the second dielectric layer 23, and the sustain electrode pairs 30. As a result, only 60% of the visible light emitted from the phosphor layers 15 passes through the front substrate 20. Therefore, luminous efficiency and brightness of the panel 5 of FIG. 1 are limited.

Figure 2:
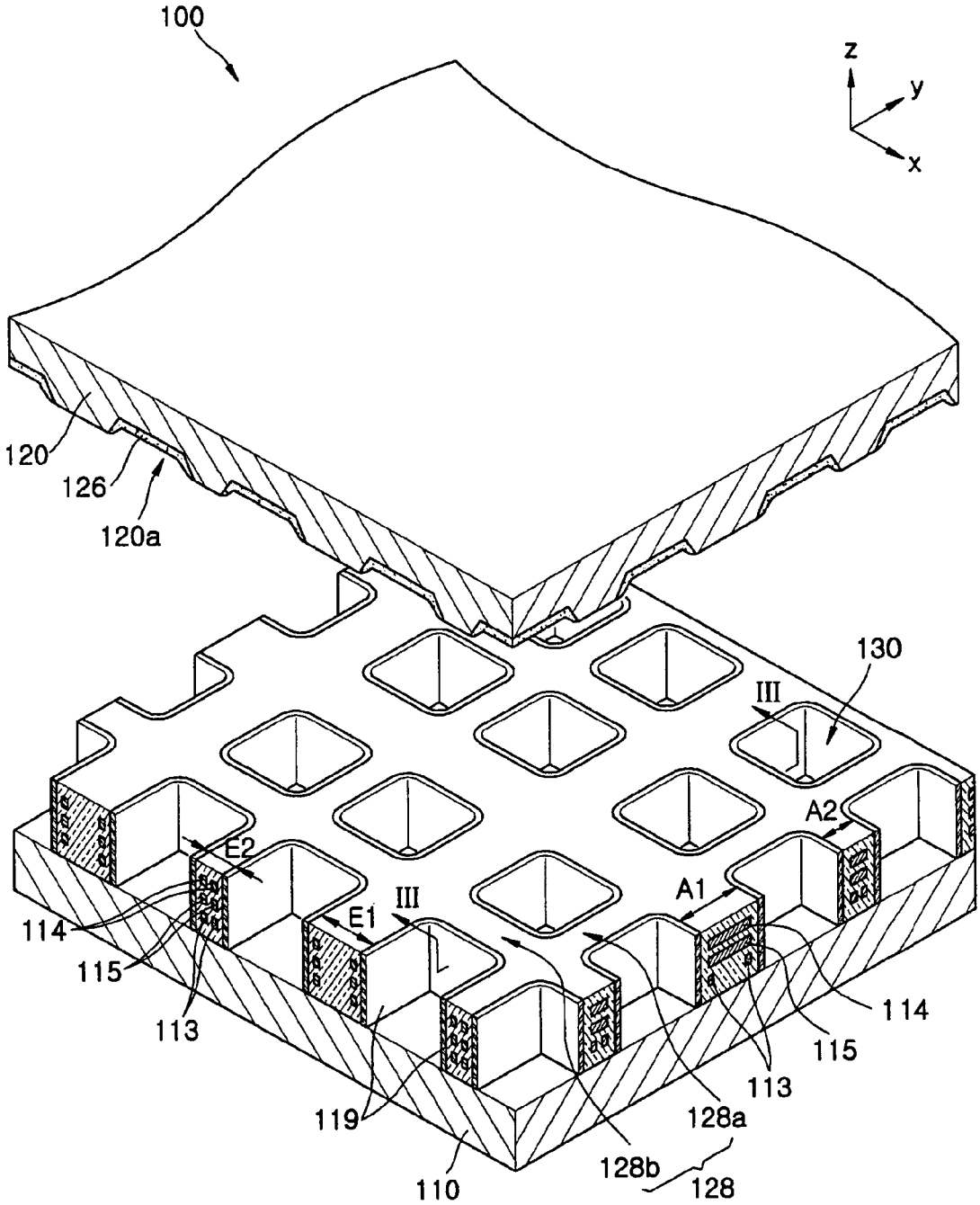
FIG. 2 is an exploded perspective view of a plasma display panel according to a first embodiment of the present invention.
Figure 3:
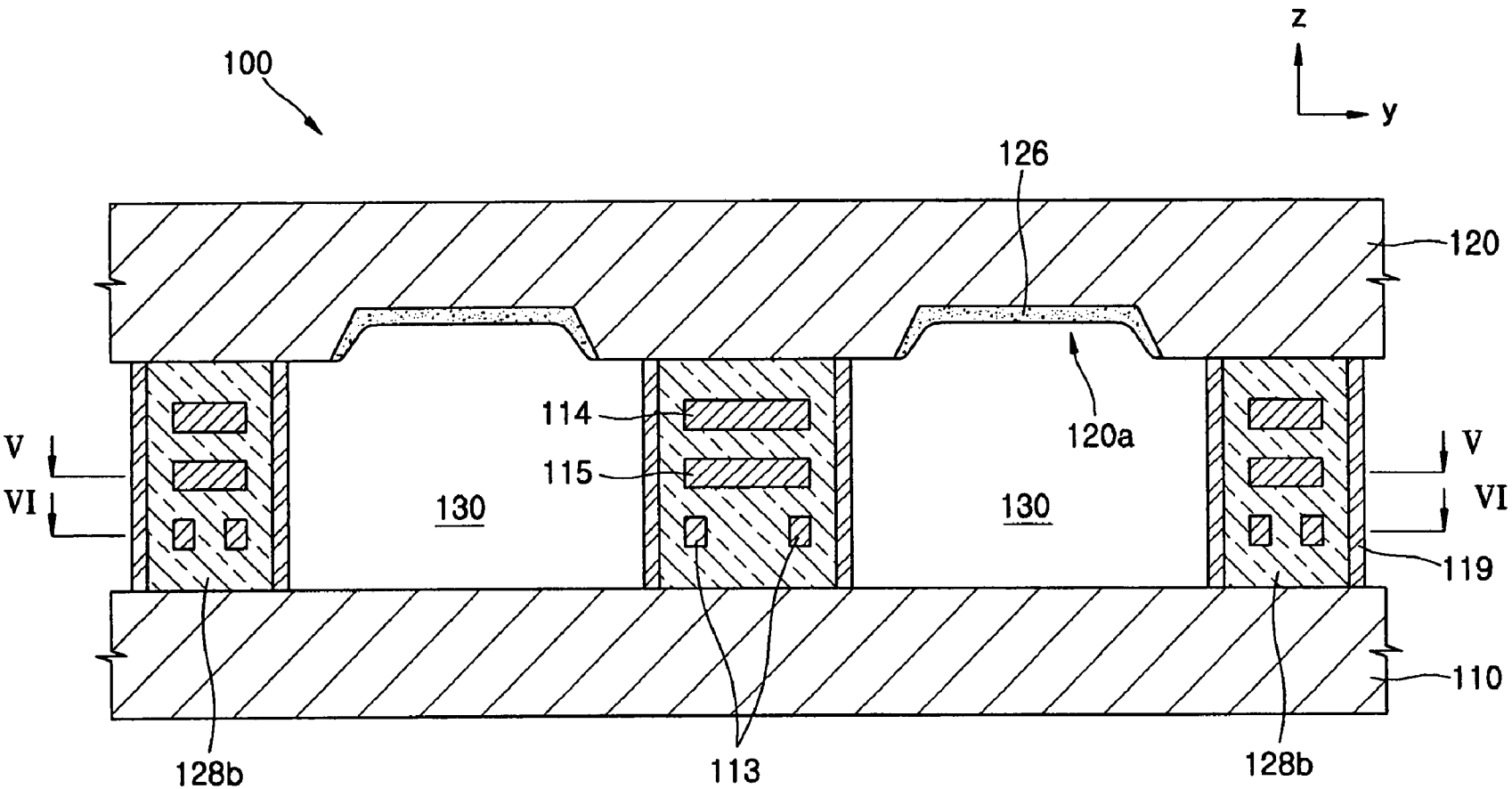
FIG. 3 is a cross-sectional view of the plasma display panel of FIG. 2 taken along line III-III.
Figure 4:
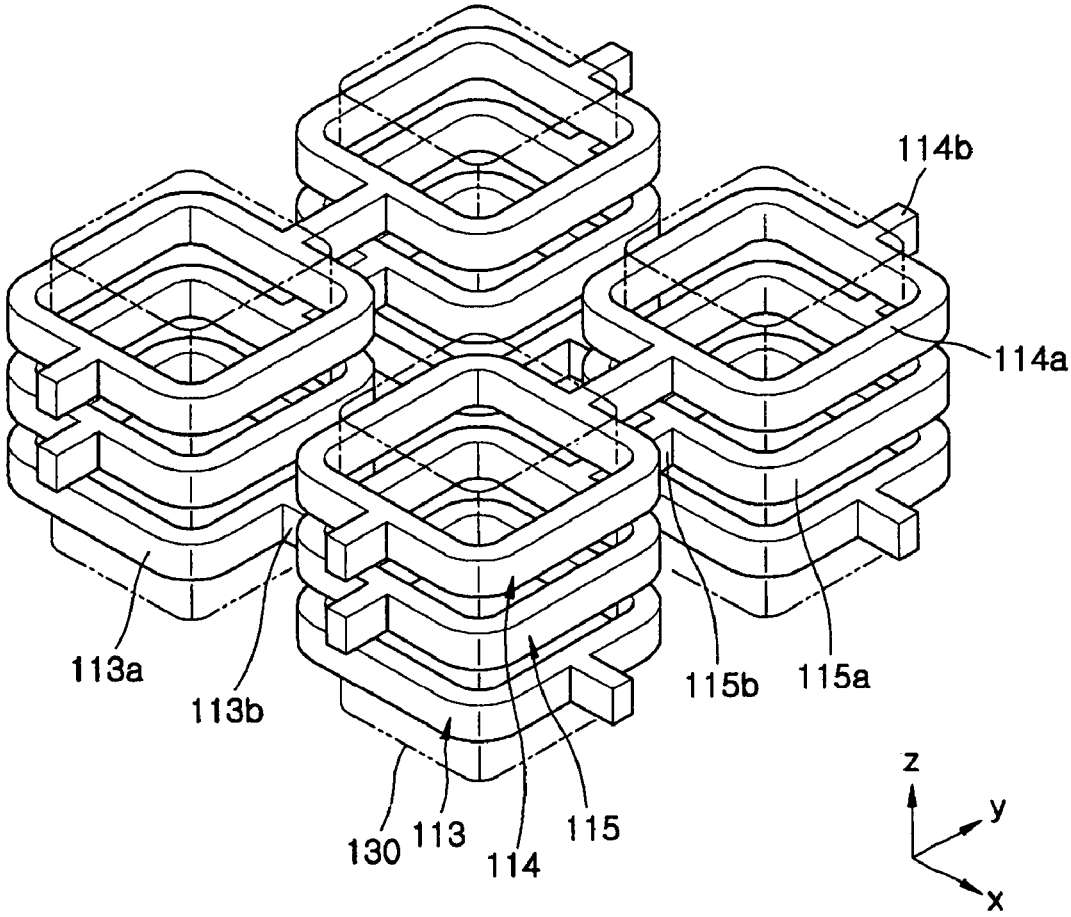
FIG. 4 is a view of arrangements of discharge cells and electrodes of the plasma display panel of FIG. 2.
Figure 5:
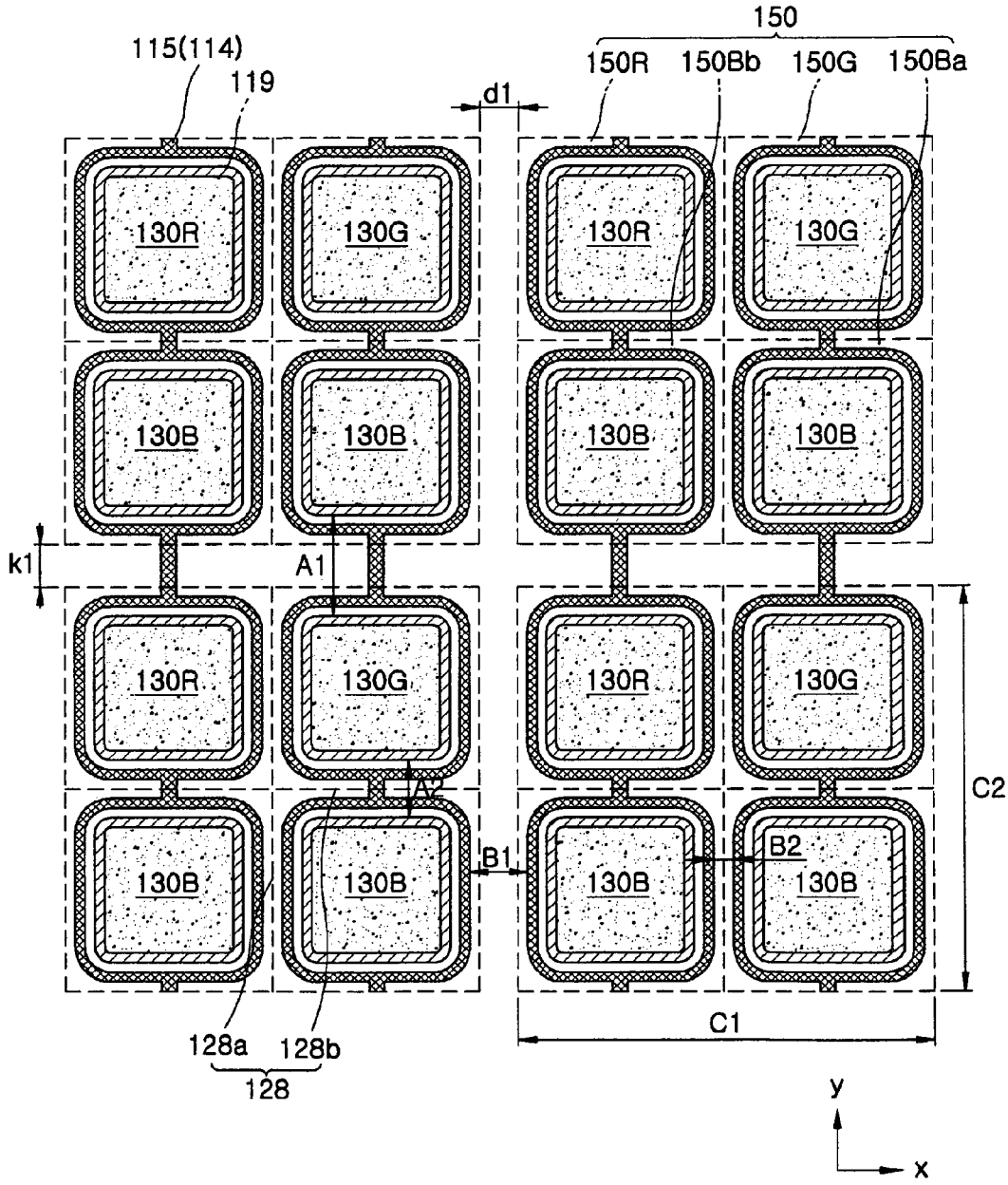
FIG. 5 is a view of arrangements of discharge cells, sub-pixels, and unit pixels of the plasma display panel of FIG. 2 taken along line V-V of FIG. 3.
Figure 6:
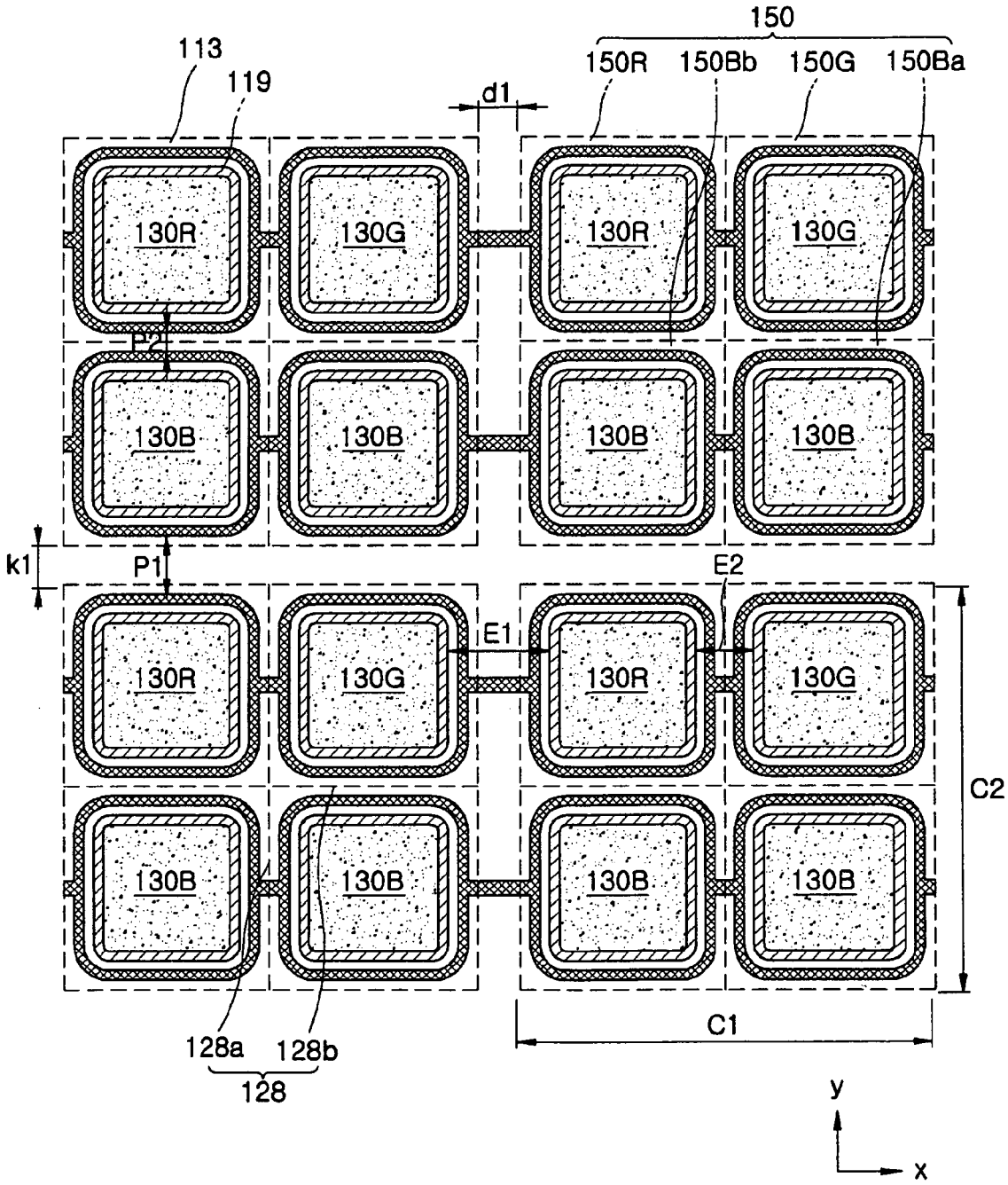
FIG. 6 is a view of arrangements of discharge cells, sub-pixels, and unit pixels of the plasma display panel of FIG. 2 taken along line VI-VI of FIG. 3.

Turning now to FIGS. 2 through 6, FIG. 2 is an exploded perspective view of a plasma display panel 100 according to a first embodiment of the present invention, and FIG. 3 is a cross-sectional view of the plasma display panel 100 of FIG. 2 taken along line III-III, FIG. 4 is a view of an arrangement of discharge cells and electrodes of the plasma display panel 100 of FIG. 2, FIG. 5 is a view of arrangements of discharge cells, sub-pixels, and unit pixels of the plasma display panel 100 of FIG. 2 taken along line V-V of FIG. 3 and FIG. 6 is a view of arrangements of the discharge cells, the sub-pixels, and the unit pixels of the plasma display panel 100 of FIG. 2 taken along line VI-VI of FIG. 3.

Referring now to FIGS. 2 and 3, the plasma display panel 100 includes a front substrate 120, phosphor layers 126, barrier ribs 128, first discharge electrodes 114, second discharge electrodes 115, address electrodes 113, a protective layer 119, and a rear substrate 110. The rear substrate 110 and the front substrate 120 are spaced apart from each other. Between the rear substrate 110 and the front substrate 120 are a plurality of discharge cells 130 partitioned by a plurality of barrier ribs 128. Each of the discharge cells 130 corresponds to one of a red sub-pixel 150R, a green sub-pixel 150G, and a blue sub-pixel 150Ba or 150Bb respectively. A predetermined number of sub-pixels form a unit pixel, which will be described later.

The front substrate 120, through which visible light emitted from the discharge cells 130 is transmitted, is formed of a material having a high light transmittance, such as glass. The rear substrate 110 is also generally formed of glass. In the present invention, the visible light generated by the discharge cells 130 exits through the front substrate 120, however the visible light can exit through the rear substrate 110 or both of the front and rear substrates 120 and 110 and still be within the scope of the present invention.

Referring now to FIG. 2, the discharge cells 130 are disposed in a matrix shape, and the barrier ribs 128 are arranged so that transverse cross sections of the discharge cells 130 have substantially a square shape. However, the discharge cells 130 are not limited to the above arrangement, and can be formed in various patterns, such as a waffle shape or a delta shape. In addition, the transverse cross sections of the discharge cells 130 can be of other polygons, such as a triangle or pentagon, or be of a circular shape or an oval shape. However, it is preferable that the discharge cells 130 have substantially square cross-sections so that the unit pixels 150 can also have a square shape. In particular, corners of the discharge cell 130 are rounded to prevent the discharge from concentrating at the corners, allowing for the discharge to occur uniformly in the discharge cells 130. The barrier ribs 128 include transverse barrier ribs 128*b* extending in a direction parallel to the address electrodes 113, and longitudinal barrier ribs 128*a* crossing the transverse barrier ribs 128*b*.

Referring now to FIGS. 2 and 4, first discharge electrodes 114 and second discharge electrodes 115, extending in parallel to each other while surrounding the discharge cells 130 along a predetermined direction (y direction), are disposed within the barrier ribs 128. In each discharge cell 130, the first discharge electrode 114 and the second discharge electrode 115 form a pair to generate a sustain discharge. Each of the first discharge electrodes 114 includes loop portions 114*a* surrounding the discharge cells 130, and connection portions 114*b* connecting the loop portions 114*a* together. In addition, each of the second discharge electrodes 115 includes loop portions 115*a* surrounding the discharge cells 130 and connection portions 115*b* connecting the loop portions 115*a* together. It is preferable that the loop portions 114*a* of the first discharge electrode 114 and the loop portions 115*a* of the second discharge electrode 115 are formed to be symmetric with each other in order to produce a uniform discharge with the discharge cells 130.

Referring now to FIG. 4, the address electrodes 113 surround discharge cells 130 in a direction (x direction) and extend in a direction crossing the direction (y direction) that the first and second discharge electrodes 114 and 115 extend. As with the first and the second discharge electrodes 114, 115, each of the address electrodes 113 include a loop portion 113*a* and a connection portion 113*b* connecting together the loop portions 113*a*. The address electrodes 113 are embedded within the barrier ribs 128. The address electrodes 113 generate an address discharge that selects the discharge cells in which sustain discharge is to take place. The address discharge lowers the voltage needed to initiate the sustain discharge. The address discharge occurs between a scan electrode and an address electrode. When the address discharge is suspended, positive ions are accumulated on the scan electrode side and electrons are accumulated on a common electrode side. As a result, the sustain discharge between the scan electrode and the common electrode can occur more easily. The address voltage necessary for the address discharge is reduced when the distance between the scan electrode and the address electrode is small. Because of this, the second discharge electrodes 115 serve as the scan electrodes and the first discharge electrodes 114 serve as the common electrodes. Therefore, the address discharge occurs between the second discharge electrodes 115 and the address electrodes 113 and it is important that the distance therebetween is small.

In addition, the first discharge electrodes 114, the second discharge electrodes 115, and the address electrodes 113 are spaced apart from each other in a direction that is perpendicular to the front substrate 120, however, the present invention is in no way so limited. The address electrode 113 can be disposed between the first and the second discharge electrodes 114 and 115, or the electrodes can be disposed in an order of the address electrodes 113, the second discharge electrodes 115, and the first discharge electrodes 115 so that the address electrodes 113 can be adjacent to the front substrate 120. In addition, the address electrodes 113 can instead be disposed on the rear substrate 110. However, in all cases above, it is preferable that the one of the first discharge electrode 114 and the second discharge electrode 115 closest to the address electrode 113 serves as the scan electrode so that a lower address discharge voltage is needed for the address discharge.

In the first embodiment, since the first and second discharge electrodes 114 and 115 are disposed within the barrier ribs 128, they do not obstruct the transmittance of visible light produced in the discharge cells 130 and traveling in the z direction through the front substrate 120 for viewing. Therefore, the first and second discharge electrodes 114 and 115 can be made out of an opaque metal having a high electrical conductivity, such as aluminum or copper, instead of using indium tin oxide (ITO). As a result, a voltage drop along the first and the second discharge electrodes 114 and 115 can be reduced. Therefore, the signal can be transmitted stably along the first and the second discharge electrodes 114 and 115 and fabrication costs of the plasma display panel can be reduced. In addition, it is preferable that the address electrodes 113 are also made out of the metal having high electric conductivity, such as the aluminum and copper.

The barrier ribs 128 are made out of a material that prevent the adjacent first and second discharge electrodes 114 and 115 and the address electrodes 113 from shorting each other. The barrier ribs 128 are formed of a dielectric material so as to prevent the electrodes 113, 114, and 115 from being damaged due to the direct collision with the positive ions and the electrons produced within the discharge cells 130 during discharge. The barrier ribs 128 also serve to accumulate wall charges.

Grooves 120*a* are formed in the front substrate 120 on a rear side that faces the discharge cells 130. The grooves 120*a* are discontinuously formed in the front substrate, and preferably face the centers of the discharge cells 130. However, shapes of the grooves 120*a* are not limited to the above example. The grooves 120*a* are formed to predetermined depths. Therefore, the thickness of the front substrate 120 can be reduced by the grooves 120*a*, resulting in a higher transmittance of light through the front substrate 120.

Red, green, and blue phosphor layers 126 are applied to predetermined thicknesses within the grooves 120*a*. However, the phosphor layers 126 can also be formed at other portions of the discharge cells 130. It is preferable that the phosphor layers 126 are disposed between the front substrate 120 and the first discharge electrodes 114 so that the electrodes and the barrier ribs are less apt to obstruct light generated in the phosphor layers and traveling in the z direction through the front substrate 120 and so that ions produced during the sustain discharge between the electrodes do not sputter the phosphor layer 126.

Red discharge cells 130R, where the red phosphor layers are disposed, correspond to red sub-pixels 150R. Green discharge cells 130G, where the green phosphor layers are disposed, correspond to green sub-pixels 150G. Blue discharge cells 130B, where the blue phosphor layers are disposed, correspond to blue sub-pixels 150Ba and 150Bb. The phosphor layers 126 include a phosphor material that emits visible light upon being energized by ultraviolet rays. Specifically, the red phosphor layer includes a phosphor material such as $Y(V,P)O_4$:Eu, the green phosphor layer includes a phosphor material such as $Zn_2SiO_4$:Mn, and the blue phosphor layer includes a phosphor material such as BAM:Eu.

Protective layers 119 can be formed on side surfaces of the barrier ribs 128. The protective layers 119 serve to prevent the barrier ribs 128 made of dielectric material, the first discharge electrodes 114, the second discharge electrodes 115 and the address electrodes 113 from being damaged by sputtering of the plasma particles. Protective layers 119 also serve to lower the discharge voltage by emitting secondary electrons. The protective layers 119 can be formed by applying MgO to the side surfaces of the barrier ribs 128 to a predetermined thickness. The protective layers 119 are mainly formed as thin films via sputtering or via an electron beam evaporation process.

A discharge gas, such as Ne, Xe or a mixture thereof, is filled within the discharge cells 130. In the plasma display panel designs of the present invention, the surface where the discharge occurs is increased and the discharge area is expanded, so that the amount of plasma can be increased and so that the plasma display panel can be driven at a lower voltage. Therefore, even when a high concentration Xe gas is used as the discharge gas, the plasma display panel can still be driven at a low voltage, resulting in a noticeable improvement in the luminous efficiency. If a high concentration Xe gas is used in the plasma display panel of FIG. 1, the display of FIG. 1 would be difficult to operate at low voltages.

Referring now to FIGS. 5 and 6, the sub-pixels 150R, 150G, 150Ba, and 150Bb and unit pixels 150 in the plasma display panel 100 are arranged as shown in FIGS. 5 and 6. Each of the unit pixels 150 includes four sub-pixels 150R, 150G, 150Ba, and 150Bb. In the present embodiment, each of the sub-pixels is a virtual region including the first discharge electrode 114, the second discharge electrode 115, the address electrode 113, each surrounding the discharge cell 130, and a predetermined portion of the barrier ribs 128 in which the electrodes 113, 114, and 115 are embedded within. The unit pixel 150 includes one red sub-pixel 150R, one green sub-pixel 150G, and two blue sub-pixels 150Ba and 150Bb. In a general plasma display panel, the brightness of blue light emitted from the blue discharge cells is low. Therefore, in order to reinforce the brightness of the blue light, the number of the blue sub-pixels included in the unit pixel can be made larger than the number of other sub-pixels of other colors. In addition, in the unit pixel 150, the sub-pixels are arranged in an order of the red sub-pixel 150R, the green sub-pixel 150G, the blue sub-pixel 150Ba, and the blue sub-pixel 150Bb in a predetermined direction. However, positions of the sub-pixels within the unit pixel are not limited thereto. It is possible to have the number of red sub-pixels or the number of green sub-pixels larger than the number of the other colors of sub-pixels and still be within the scope of the present invention.

It is preferable that the unit pixel 150 is formed as a square having a transverse length C1 and a longitudinal length C2 equal to each other. With such an arrangement, it is possible to form the entire shape of the plasma display panel freely. It is preferable that the sub-pixels are also formed as squares so that the unit pixel 150 can be formed as the square.

Referring now to FIG. 5, the unit pixels 150 arranged in the y direction parallel to the first and second discharge electrodes 114 or 115. Between unit pixels 150, the first and the second discharge electrodes 114,115 are spaced apart from each other by a predetermined distance k1. This distance k1 between the unit pixels 150 can be achieved by various techniques. In FIG. 5, this distance k1 is achieved by varying the widths of the barrier ribs 128 at different locations. In FIG. 5, the width A1 of the transverse barrier rib between two different unit pixels 150 is larger than a width A2 of the transverse barrier rib between two different sub-pixels within a single unit pixel.

Referring now to FIG. 6, the unit pixels 150 arranged in the x direction parallel to the address electrodes 113. In FIG. 6, the unit pixels 150 are spaced apart from each other by distance d1. The distance d1 between the unit pixels 150 can be achieved by various techniques. In FIG. 6, a width E1 of the longitudinal barrier rib between two different unit pixels 150 is larger than a width E2 of the longitudinal barrier rib between two different sub-pixels within a single unit pixel 150.

In the plasma display panel of FIG. 1, since there is no gap between the unit pixels, the adjacent electrodes are very close to each other. Because of this, when the voltage is applied to the electrodes, reactive power is produced between the adjacent electrodes. The reactive power is generated by a displacement current that is proportional to an electrostatic capacitance and to a voltage versus time. Therefore, when voltage pulses different from each other are applied between the adjacent electrodes in the plasma display panel of FIG. 1, the displacement current is generated due to the change of voltage. Here, an electric capacitance between the corresponding electrodes is in proportion to a relative dielectric constant and facing areas of the electrodes, and is in inverse proportion to the distance between the electrodes. Therefore, if the distance between the electrodes is short, the electrostatic capacitance increases and thus the displacement current and the reactive power increase.

In the present invention, different voltages can be applied to the second discharge electrodes 115 serving as the scan electrodes and the address electrodes 113. For example, address voltage pulses are applied to the address electrodes 113 disposed on the sub-pixel that is intended to generate a certain address discharge, and the address voltage pulses are not applied to the other address electrodes 113. In addition, scan pulses can be applied to the second discharge electrodes 115 disposed in the sub-pixel that is intended to generate the address discharge, and the scan pulses are not applied to the other second discharge electrodes 115. In particular, the change of voltage pulses applied to the address electrodes 113 and to the second discharge electrodes 115 becomes larger for certain patterns (for example, on a dot-on-off pattern). The inconsistency between the voltage pulses applied to the address electrodes 113 and the voltage pulses applied to the second discharge electrodes 115 induces a displacement current, and thus the reactive power of the plasma display panel increases.

Therefore, it is preferable that the distance between the address electrodes 113 and the distance between the second discharge electrodes 115 are made larger in order to reduce the reactive power. However, if the distances between all of the address electrodes 113 and the distance between all of the second discharge electrodes 115 are made large, it would be difficult to fabricate the plasma display panel having a fine pitch. When the distances between the address electrodes 113 and the distances between the second discharge electrodes 115 increase, the number of unit pixels should be reduced or the sizes of discharge cells should be reduced to compensate. Therefore, a resolution or a brightness of the plasma display panel can be degraded. Therefore, the present invention solves this problem by making the distances d1 and k1 between the adjacent unit pixels 150 large, so that the distance P1 between address electrodes 113 and the distance B1 between second discharge electrodes 115 in adjoining unit pixels large. At the same time, the present invention contemplates having the distance P2 between the address electrodes 113 and a distance B2 between the second discharge electrodes 115 within the same unit pixel to be substantially shorter than the distances P1 and B1. By doing so, the reactive power can be kept small while obtaining the fine pitch.

According to the present embodiment, since the width A1 of the transverse barrier rib surrounding a unit pixel 150 is larger than the width A2 of the transverse barrier rib disposed within a single unit pixel, and the width E1 of the longitudinal barrier rib surrounding a unit pixel 150 is wider than the width E2 of the longitudinal barrier rib within a single unit pixel 150, the above arrangements of the unit pixels can be formed. Therefore, the plasma display panel can be fabricated to have a fine pitch while reducing the reactive power. In the plasma display panel having the above described structure, the reduction of plasma discharge caused by the reduction of transverse cross-sections of the discharge cells 130 can be compensated for through an increase of the depth (z-direction) of the discharge cells 130. Arrangements of the first discharge electrodes 114 are similar to those of the second discharge electrodes 115, and thus, detailed descriptions thereof are omitted.

The plasma display panel 100 having the structure according to the above first embodiment of the present invention operates as follows. When the address voltage is applied between the address electrodes 113 and the second discharge electrode 115 to generate the address discharge, the discharge cell 130 where the sustain discharge will later occur is selected. In addition, when the sustain voltage is alternately and repeatedly applied between the first discharge electrode 114 and the second discharge electrode 115 of the selected discharge cell 130, wall charges accumulated on the first and second discharge electrodes 114 and 115 during the address discharge serve to generate the sustain discharge. Then, an energy level of the discharge gas that is excited during the sustain discharge becomes lower when the discharge gas generates ultraviolet rays. The ultraviolet rays excite the phosphor layer 126 within the discharge cell 130, and when an energy level of the exited phosphor layer 126 falls, visible light is emitted and transmitted through the front substrate 120 to form an image that a viewer can recognize.

In the plasma display panel 5 of FIG. 1, the sustain discharge between the sustain electrodes 21 and 22 occurs in a horizontal direction, and thus, the discharge area is small. However, in the plasma display panel 100 according to the present invention, the sustain discharge occurs from all sides defining the discharge cell 130, and thus the discharge area is large. In addition, the sustain discharge according to the present embodiment is formed in the shape of a closed loop along the sides of the discharge cell 130, and then the sustain discharge diffuses towards the center of the discharge cell 130. Therefore, the volume of the space where the sustain discharge occurs increases, and space charges in the discharge cell 130 can contribute to the discharge. Therefore, the luminous efficiency of the plasma display panel can be improved. In the plasma display panel 100 of the present invention, since the sustain discharge occurs at the center portion of the discharge cell 130, ion sputtering of the phosphor layers due to the charged particles can be prevented, and thus, a permanent residual image is not generated even when the same image is displayed for a long time.

Figure 7:
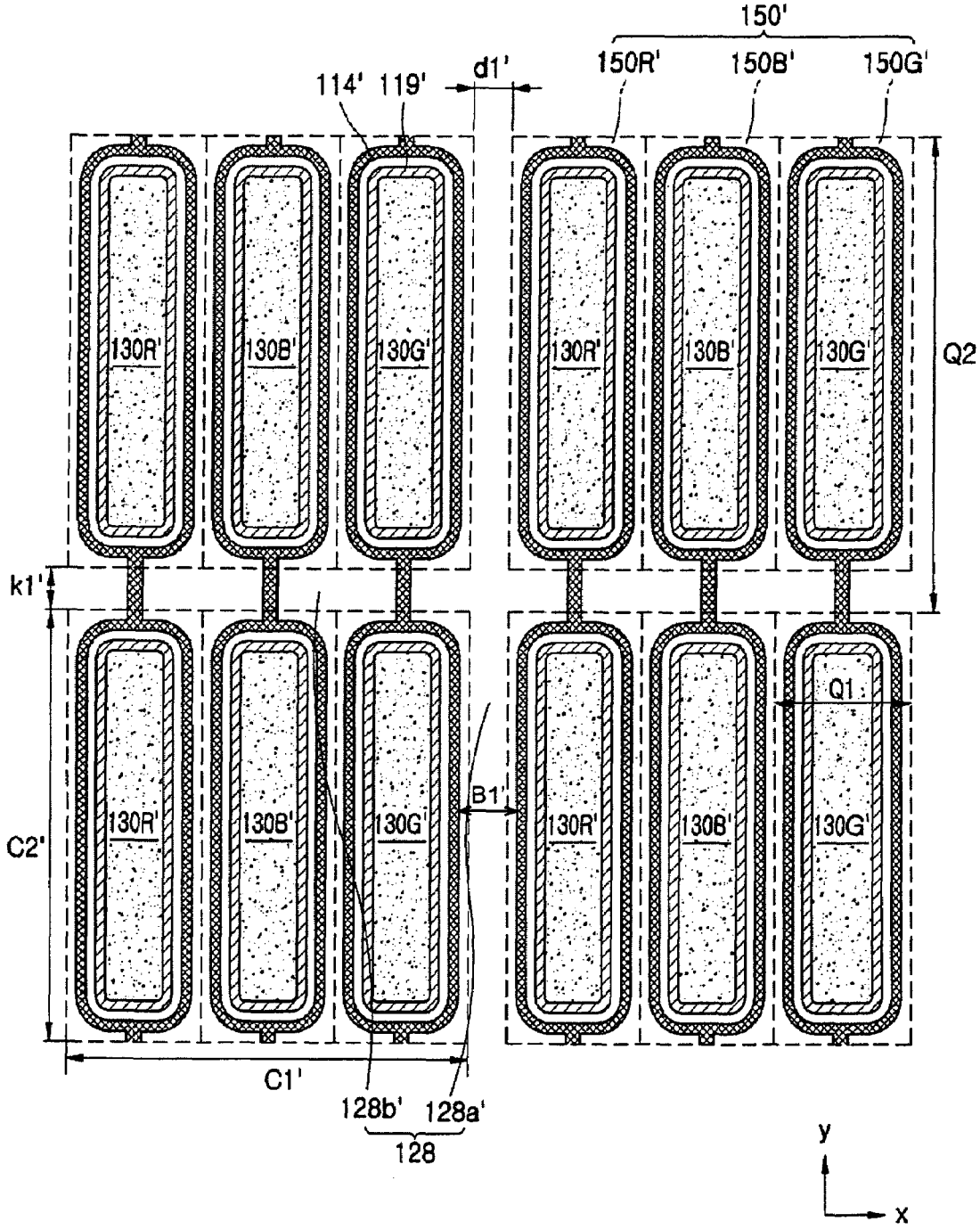
FIG. 7 is a view of arrangements of the discharge cells, the sub-pixels, and the unit pixels corresponding to FIG. 5 in a modified example of the plasma display panel according to the first embodiment of the present invention.

Turning now to FIG. 7, FIG. 7 is a view of alternate arrangements of red, green, and blue discharge cells 130R', 130G', and 130B', red, green, and blue sub-pixels 150R', 150G', and 150B', and unit pixels 150' according to a modified example of the plasma display panel of the first embodiment. FIG. 7 is analogous to FIG. 5 above as barrier ribs 128' including second discharge electrodes 114', protective layers 119', longitudinal barrier ribs 128*a*', and transverse barrier ribs 128*b*' of FIG. 7 are similar to barrier ribs 128 including second discharge electrodes 114, protective layers 119, longitudinal barrier ribs 128*a* and transverse barrier ribs 128*b*' of FIG. 5 and thus a detailed description of these elements will be omitted.

FIG. 7 is different from FIG. 5 in that the sub-pixels 150R', 150G', and 150B' are rectangular instead of being square. As illustrated in FIG. 7, transverse lengths Q1 and longitudinal lengths Q2 of the sub-pixels 150R', 150G', and 150B' are not equal to each other. In FIG. 7, the transverse lengths Q1 are longer than the longitudinal lengths Q2. In addition, in FIG. 7, each of the unit pixels 150' includes one red sub-pixel 150R', one green sub-pixel 150G', and one blue sub-pixel 150B' instead of two blue sub-pixels as in FIG. 5. Further, in FIG. 7, it is preferable that the unit pixels 150 are square in shape so that the transverse length C1' of the unit pixel 150' is equal to the longitudinal length C2'.

As in FIG. 5, the unit pixels 150' of FIG. 7 disposed in the x direction are spaced apart from each other by a large distance d1', which results in increased distances B1' between the second discharge electrodes 114' which in turn results in the production of less reactive power. In addition, the unit pixels 150' disposed in the y direction are also spaced apart from each other at predetermined distances k1'.

Figure 8:
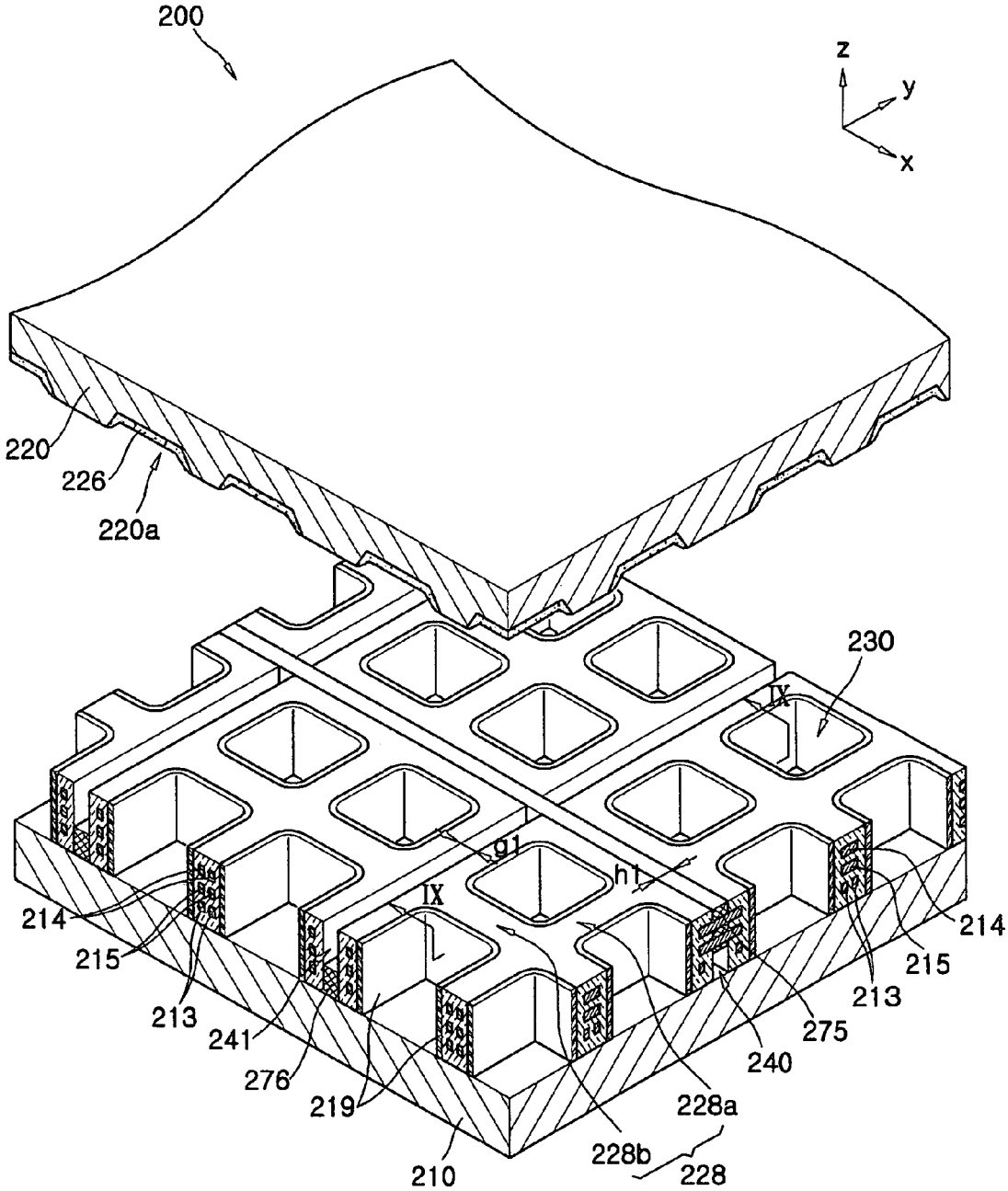
FIG. 8 is an exploded perspective view of a plasma display panel according to a second embodiment of the present invention.
Figure 9:
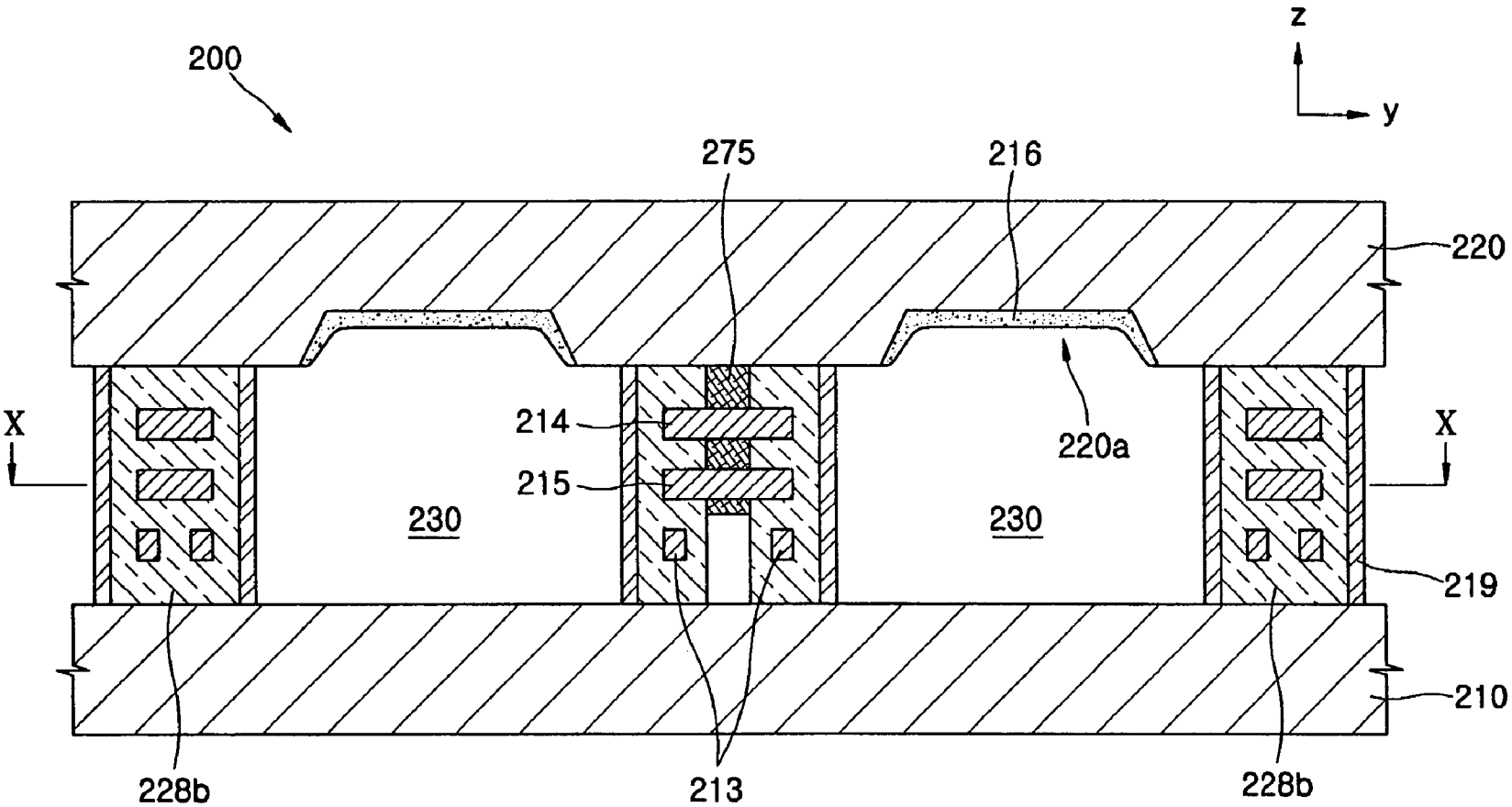
FIG. 9 is a cross-sectional view of the plasma display panel of FIG. 8 taken along line IX-IX.
Figure 10:
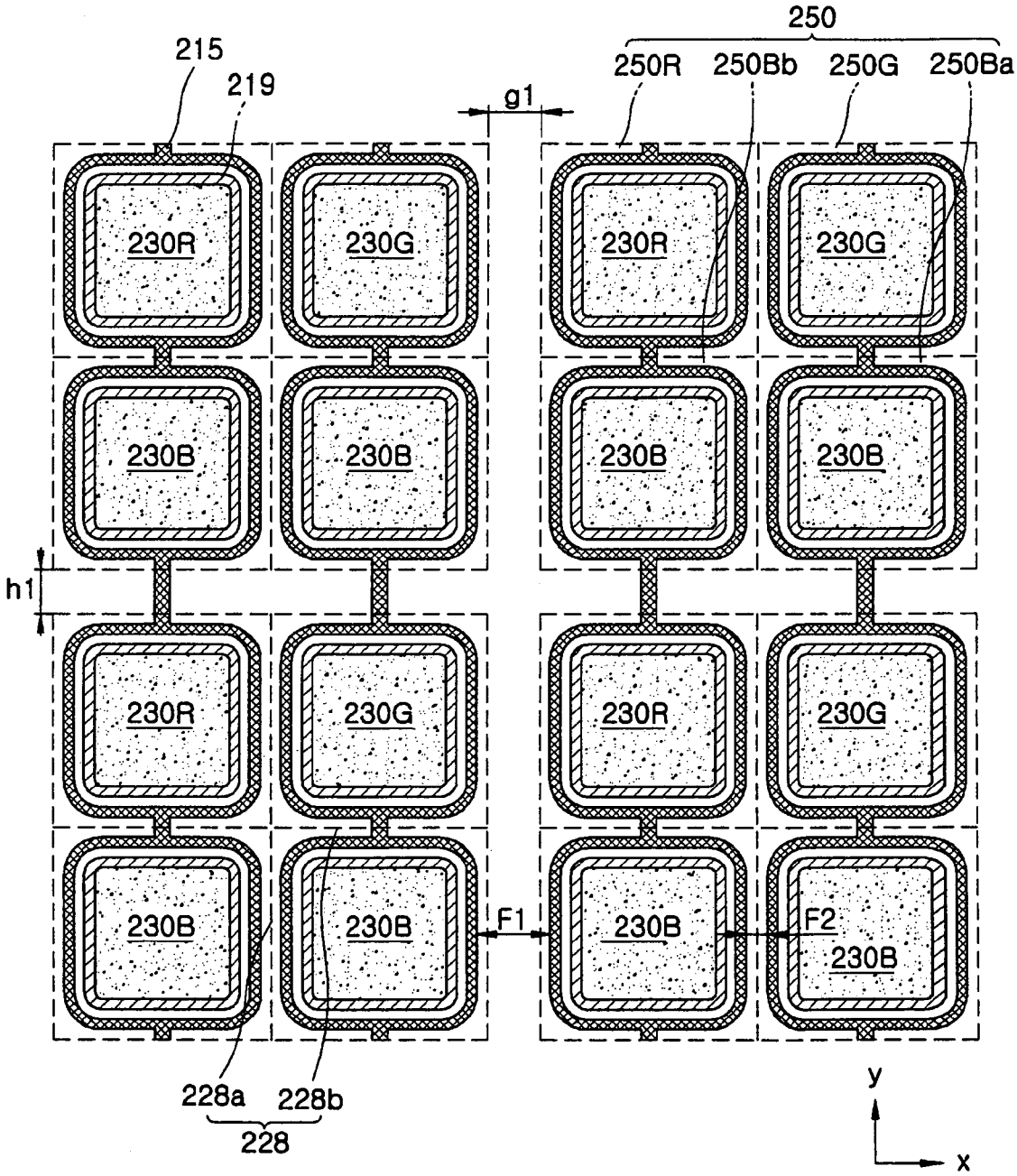
FIG. 10 is a view of arrangements of discharge cells, sub-pixels, and unit pixels of the plasma display panel of FIG. 8 taken along line X-X of FIG. 9.

Turning now to FIGS. 8 through 10, FIGS. 8 through 10 illustrate a plasma display panel 200 according to a second embodiment of the present invention. As illustrated in FIG. 8, the plasma display panel 200 includes a front substrate 220, phosphor layers 226, a rear substrate 210, barrier ribs 228, first discharge electrodes 214, second discharge electrodes 215 and address electrodes 213.

Within the barrier ribs 228 are the first discharge electrodes 214 and the second discharge electrodes 215 extending parallel to each other while surrounding the discharge cells 230 along the y direction. In the embodiment of FIGS. 8 through 10, address electrodes 213 are also arranged within barrier ribs 228 and surround rows of discharge cells 230 extending in the x direction crossing the first and second discharge electrodes 214,215 extending in the y direction. The barrier ribs 228 are made out of a dielectric material. The barrier ribs 228 can be broken down into transverse barrier ribs 228*b* extending in the x direction parallel to the address electrodes 213 and longitudinal barrier ribs 228*a* crossing the transverse barrier ribs 228*b*.

The second embodiment differs from the first embodiment in that the spaced portions between the unit pixels 250 are not entirely filled by the dielectric material, but include non-discharge areas 240 and 241 which are empty spaces.

In the plasma display panel 200, the unit pixels 250 disposed in the y direction parallel to the second discharge electrodes 215 and the first discharge electrodes 214 are spaced apart from each other with predetermined distances h1 therebetween. However, unlike the first embodiment, this entire distance in the second embodiment is not consumed entirely by the dielectric material of the barrier ribs. Instead, some of the space in this distance h1 in the second embodiment is consumed by an empty space 240 and some is also consumed by another dielectric layer 275. For forming the spaces 240, the transverse barrier ribs 228*b*, defining the unit pixels 250 disposed in the y direction where the second discharge electrodes 214 extend, are spaced apart from each other by predetermined distance h1, and the non-discharge areas 240 can be formed within spaces defined by distance h1. If the first and second discharge electrodes 214 and 215 are exposed to the non-discharge area 240, the first and second discharge electrodes 214 and 215 can be damaged. Therefore, it is preferable that the first and second discharge electrodes 214 and 215 exposed in the non-discharge area 240 are covered by the dielectric layer 275.

Referring now to FIGS. 8 and 9, the exposed first and second discharge electrodes 214 and 215 can be covered by a separate dielectric layer 275, however, the dielectric layer 275 can instead be integrally formed with the transverse barrier ribs 228*b*. In addition, in the plasma display panel 200, the unit pixels 250 disposed in the x direction parallel to the address electrodes 213 are spaced apart from each other by distance g1. In the space within this distance g1 is another empty space 241. The longitudinal barrier ribs 228*a* defining the unit pixels 250 disposed in the x direction parallel to the address electrodes 213 are spaced apart from each other by predetermined distance g1, and the non-discharge area (or empty space) 241 can be formed in that space. If the address discharge electrodes 213 are exposed to the non-discharge area 241, the address discharge electrodes 213 can be damaged. Therefore, it is preferable that the address discharge electrodes 213 exposed to the non-discharge area 241 are covered by a dielectric layer 276.

As described above, the non-discharge areas 240 and 241 are formed between the second discharge electrodes 215 (or the first discharge electrodes 214) of different unit pixels 250 and between the address electrodes 213 of different unit pixels 250. In addition, a distance F1 between the second discharge electrodes 215 of adjacent unit pixels 250 is longer than a distance F2 between the second discharge electrodes 215 within a single unit pixel 250. Although it is not shown in the drawings, the distance between the neighboring address electrodes 213 of adjacent unit pixels 250 is also larger than the distance between neighboring the address electrodes 213 within the same pixel.

Therefore, electric capacitances between the second discharge electrodes 215 of neighboring unit pixels 250 and between the address electrodes 213 of neighboring unit pixels 250 can be reduced, resulting in less displacement current and less reactive power. Reduction of the reactive power due to the large separation between a row of unit pixels arranged in a direction parallel to the second discharge electrodes 215 and the address electrodes 213 is similar to that of the first embodiment.

The front substrate 220 on which the grooves 220*a* are formed, the phosphor layers 226, the protective layers 219, the first discharge electrodes 214, the second discharge electrodes 215, the rear substrate 210, and the discharge gas are similar to the corresponding elements of the first embodiment. In addition, red sub-pixels 250R, green sub-pixels 250G, and blue sub-pixels 250Ba and 250Bb having substantially square shapes corresponding to red discharge cells 230R, green discharge cells 230G, and blue discharge cells 230B, and the unit pixel 250 of substantially square shape including one red sub-pixel 250R, one green sub-pixel 250G, and two blue sub-pixels 250Ba and 250Bb are also similar to those in the first embodiment. In addition, operations of the plasma display panel 200 according to the second embodiment are similar to those in the previous embodiment, and thus, descriptions thereof are omitted.

According to the plasma display panels of the present invention, the unit pixels are separated from each other, and thus, the reactive power can be reduced, and the luminous efficiency can be improved. In addition, the surface discharge can occur from all sides defining the discharge space, and the discharge area can be expanded greatly. Since the discharge occurs from the sides forming the discharge cell and is diffused to the center of the discharge cell, the discharge area can be expanded greatly and the entire discharge cell can be efficiently used. Therefore, the plasma display panel can be driven at low voltage, and the luminous efficiency can be improved. In addition, since the plasma display panel can be driven with the low voltage, the low voltage driving can be performed even when a high concentration Xe gas is used as the discharge gas, and thus the luminous efficiency can be further improved.

The discharge responding speed is fast, and the low voltage driving can be performed. That is, since the discharge electrodes are not disposed on the front substrate through which the visible light transmits, but instead on the sides of the discharge cells, there is no need to use transparent electrodes having low conductivity for the discharge electrodes, and the electrodes having low resistance such as the metal electrode can instead be used for the discharge electrode. Therefore, the responding speed to the discharge can be faster, and low voltage driving can be performed without distorting waveforms.

In addition, generation of a permanent residual image can be fundamentally prevented. That is, the electric field generated by the voltages applied to the discharge electrodes formed on the sides of the discharge cell concentrates the plasma toward the center portion of the discharge cell, and thus ions generated by the discharge do not collide with the phosphor layer, and the permanent residual image generated by the damage of the phosphor layer due to the ion sputtering can be totally prevented. In particular, the permanent residual image becomes worse when the high concentration Xe gas is used as the discharge gas in the plasma display panel, however, the present invention can totally prevent the generation of the permanent residual image even when a high concentration Xe gas is used as the discharge gas.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A plasma display panel, comprising:

a rear substrate;

a front substrate separated from the rear substrate;

a plurality of barrier ribs arranged between the front substrate and the rear substrate and adapted to define a plurality of discharge cells corresponding to a plurality of sub-pixels;

a plurality of sustain electrode pairs comprising a plurality of first discharge electrodes and a plurality of second discharge electrodes extending parallel to each other and surrounding at least portions of ones of the plurality of discharge cells, the plurality of sustain electrode pairs being adapted to generate a discharge;

a plurality of address electrodes surrounding at least portions of the plurality of discharge cells and extending in a direction that crosses the plurality of sustain electrode pairs;

a plurality of phosphor layers arranged within the plurality of discharge cells; and a discharge gas arranged within the plurality of discharge cells, wherein a predetermined number of sub-pixels form a unit pixel, and unit pixels adjacent to each other in a direction are spaced apart from each other by a predetermined distance, wherein ones of said plurality of barrier ribs arranged between two separate and adjoining unit pixels have a wider width than ones of said plurality of barrier ribs arranged within a single unit pixel.

2. The plasma display panel of claim 1, wherein unit pixels arranged in a direction that the plurality of sustain electrode pairs extend are spaced apart from each other at predetermined intervals.

3. The plasma display panel of claim 1, wherein the unit pixels arranged in the direction that the plurality of address electrodes extend are spaced apart from each other at predetermined intervals.

4. The plasma display panel of claim 1, wherein ones of the plurality of barrier ribs arranged between two separate and adjoining unit pixels are separated from each other at a predetermined interval and a spaced portion between the adjoining unit pixels comprises a non-discharge area.

5. The plasma display panel of claim 1, wherein the plurality of barrier ribs include a plurality of transverse barrier ribs that extend in the direction parallel to the address electrodes and a plurality of longitudinal barrier ribs that extend in a direction that crosses the plurality of transverse barrier ribs.

6. The plasma display panel of claim 5, wherein widths of ones of said plurality of longitudinal barrier ribs arranged between two separate and adjoining unit pixels are larger than widths of ones of said plurality of longitudinal barrier ribs arranged within a single unit pixel.

7. The plasma display panel of claim 5, wherein widths of ones of said plurality of transverse barrier ribs arranged between two separate and adjoining unit pixels are larger than widths of ones of said plurality of transverse barrier ribs arranged within a single unit pixel.

8. The plasma display panel of claim 1, wherein each unit pixel comprises four sub-pixels.

9. The plasma display panel of claim 8, wherein each unit pixel comprises one red sub-pixel, one green sub-pixel, and two blue sub-pixels.

10. The plasma display panel of claim 8, wherein each sub-pixel has substantially a square shape.

11. The plasma display panel of claim 8, wherein each unit pixel has substantially a square shape.

12. The plasma display panel of claim 1, wherein each unit pixel comprises three sub-pixels.

13. The plasma display panel of claim 12, wherein each sub-pixel has substantially a rectangular shape.

14. The plasma display panel of claim 12, wherein each unit pixel comprises one red sub-pixel, one green sub-pixel, and one blue sub-pixel.

15. The plasma display panel of claim 1, wherein the plurality of first discharge electrodes and the plurality of second discharge electrodes are arranged within the plurality of barrier ribs and are separated from each other in a direction perpendicular to the front substrate, and wherein the plurality of barrier ribs comprise a dielectric material.

16. The plasma display panel of claim 1, wherein the plurality of address electrodes are arranged within the plurality of barrier ribs, and wherein the plurality of barrier ribs comprise a dielectric material.

17. The plasma display panel of claim 1, wherein the plurality of phosphor layers are arranged between the front substrate and the plurality of sustain electrode pairs.

18. The plasma display panel of claim 1, wherein a plurality of grooves are arranged in the front substrate, the plurality of grooves corresponding to the plurality of discharge cells.

19. The plasma display panel of claim 18, wherein the plurality of phosphor layers are arranged within the plurality of grooves.

20. The plasma display panel of claim 18, wherein the plurality of grooves are discontinuously arranged on the front substrate and correspond to the plurality of discharge cells.

21. The plasma display panel of claim 1, further comprising a plurality of protective layers covering at least some portions of sidewalls of the plurality of barrier ribs.

* * * * *